US005419654A

United States Patent [19]

Kleiger

[11] Patent Number: 5,419,654

[45] Date of Patent: May 30, 1995

[54] VEHICLE FOR ROAD REPAIR AND THE LIKE

[76] Inventor: Scott P. Kleiger, 70 E. Cleveland Ave., Morrisville, Pa. 19067

[21] Appl. No.: 951,665

[22] Filed: Sep. 25, 1992

[51] Int. Cl.[6] ..... E01C 23/02

[52] U.S. Cl. ..... 404/101; 404/107; 404/108; 404/111; 366/22

[58] Field of Search ..... 404/75, 101, 107, 108, 404/109, 110, 111; 366/22, 23, 24, 40

[56] References Cited

U.S. PATENT DOCUMENTS

| | | | |
|---|---|---|---|
| 4,511,284 | 4/1985 | Sterner | 404/111 |
| 4,678,363 | 7/1987 | Sterner | 404/75 |
| 4,812,076 | 3/1989 | Yant | 404/108 |
| 5,232,306 | 8/1993 | Sterner | 404/107 |
| 5,263,790 | 11/1993 | Bickley et al. | 404/107 |

*Primary Examiner*—John Husar
*Attorney, Agent, or Firm*—Louis Weinstein

[57] ABSTRACT

A motor driven wheeled road patching vehicle includes a gravel hopper and a tank of heated asphalt. A gate assembly is adjusted to control gravel flow into a pressurized hose. A telescoping tube assembly extendable between a maximum and a minimum overall length for patching operations and compactness when not in use has debris air gaps to facilitate, by venturi effect, debris clearance. Telescoping elements of increasing diameter are further from the inlet end of the tube assembly to reduce wearing. An elbow couples the telescoping tube outlet to a mixing head, and has a hollow collector box for accumulating gravel which erodes the outside elbow portion, the collected material serving to prevent further wearing. The tank is heated by thermostatically controlled heater elements when not in use and by engine coolant from the truck engine coolant system flowing through a tube near the bottom of the tank. A nozzle, heated by the engine cooling system, mixes molten asphalt and gravel. Baffles in the nozzle and heating tube create a tortuous coolant path, enhancing heat transfer from the nozzle and tube to the molten asphalt. A control panel in the truck cabin is mounted by flexible ducting comprising two or more flexible ducts, each duct of smaller diameter being force-fitted into the next duct so that the O.D. of each duct firmly engages the I.D. of each outer duct providing a superior flexible mount. Electrical conduit and the like extend through the innermost duct.

42 Claims, 7 Drawing Sheets

VEHICLE FOR ROAD REPAIR AND THE LIKE

FIELD OF THE INVENTION

The present invention relates to roadway repair systems and more particularly to a novel wheeled, motor driven vehicle having means for maintaining asphalt stored therein in a molten state regardless of the use or non-use of the vehicle, and for delivering and mixing molten asphalt and gravel in a heated mixing head wherein the asphalt storing tank and heated mixing head advantageously employ the vehicle cooling system to provide appropriate heating during patching activities.

BACKGROUND OF THE INVENTION

It is well-known to repair roads and, for example by filling such potholes with a mixture of gravel and asphalt. In one such system, Automated Road Repair Systems, Inc. has provided apparatus including a motor driven wheeled vehicle transporting a gravel hopper and a storage tank for liquid asphalt, as well as a pressurized conduit for advancing gravel to a mixing head. Conduit is further provided for delivering asphalt from the storage tank to the mixing head arranged at a free end of a telescoping boom which is swingably mounted, preferably at the front end of the truck and is articulated in such a manner as to be swingable in both horizontal and vertical planes as well as being selectively extendable and extractable to facilitate positioning of the mixing head above a roadway surface to be patched. The pressurized conduit is preferably initially employed to blow debris from the pothole or crevice to be patched. Then either asphalt with or without gravel is delivered to the mixing head. The use of high pressure air typically eliminates the need for rolling or tamping.

The vehicle is capable of operation by one man replacing an entire crew of four or more men when employing conventional patching equipment in use prior to the equipment offered by Automated Road Repair Systems, Inc.

Improvements have been made to the aforesaid system which include a vane type control valve for selectively controlling the gravity flow of gravel from the gravel hopper and which has better wear characteristics; and a telescoping gravel hose assembly and a flexible asphalt delivery conduit which is maintained substantially taut and under tension over the entire range of expansion and contraction of the telescoping boom, said improvements being disclosed in pending application Ser. No. 07/724,418 filed Jul. 3, 1991, now U.S. Pat. No. 5,263,790.

The vane type feeder valve described in the aforementioned pending application Ser. No. 07/724,418 now U.S. Pat. No. 5,263,790, lacks the ability to alter the flow rate without changing the throw of the hydraulic operating system. The telescoping gravel conduit lacks a self-cleaning arrangement and further is provided with an elbow for coupling the telescoping aggregate conveyor to the mixing valve which mixing valve lacks heating means for maintaining the asphalt in the molten state preparatory to application upon a roadway.

In addition thereto, the prior technique lacks a tank capable of being heated selectively by either the engine cooling system of the vehicle or auxiliary electrical means and further lacks a control unit of simplified design which facilitates easy and rapid orientation of the control panel.

BRIEF DESCRIPTION OF THE INVENTION

The present invention is characterized by comprising an asphalt storage tank having an elongated tube extending through said tank and being welded therethrough to provide a water-tight seal. Inlet and outlet couplings are provided between said tube and the engine cooling system of the vehicle wherein coolant passes through said tube during operation of the engine. Baffles provided within the tube cause the coolant flow to be substantially, evenly distributed throughout the tube to assure proper heating of the asphalt.

Auxiliary means in the form of electrical heating elements are inserted into opposing ends of the heating tube for coupling with external powers such as a 110 volt AC source. A thermostat is provided to maintain the proper heat level. An important advantage is derived from the aforesaid system in that asphalt stored overnight in the tank is maintained at 180° F., for example. When starting the vehicle engine, especially on cold mornings, the heat stored in the heated asphalt is conducted to the engine coolant which immediately begins to circulate heated coolant through the system to greatly enhance and assure starting of the engine, especially at freezing or sub-freezing ambient temperatures.

The conduit coupling the asphalt from the storage tank extends through an insulated, non-collapsible conduit through which delivery and return lines from the coolant system extend. The conduit is prevented from sagging or developing slack by a spring-loaded pulley which maintains the non-collapsible hose substantially taut regardless of the amount of extension or retraction experienced by the boom. The pulley is rotatably supported by a slidably mounted bracket having rollers guided within a track. Spring means normally draws the pulley in a direction which reduces the overall length of the conduit while being yieldable to increase the overall linear length of the conduit by spring means, the pulley retaining the flexible but non-collapsible hose in a substantially U-shaped configuration. Tension upon the pulley is obtained through the use of a pair of tension springs, one mounted within the other. An intermediate coupling elbow provides strain relief for the conduit.

The water lines coupling the cooling system to the mixing head extend into a first hollow toroidal shaped chamber which surrounds a second hollow toroidal shaped emulsion chamber which in turn surrounds a hollow mixing cylinder. The inlet end of the mixing cylinder receives gravel from the gravel conduit and releases gravel through the outlet end thereof. The cylinder is provided with openings at spaced intervals about the cylinder, which openings communicate with the second toroidal shaped emulsion chamber, which receives the molten asphalt and passes the molten asphalt into the interior of the cylindrical member through said openings, the asphalt hose preferably being pressurized.

The hollow heating chamber is provided with baffles to facilitate even distribution of the coolant therethrough and maintains the asphalt at the proper temperature preparatory to being mixed with the flow of aggregate for delivery to a roadway.

The aggregate is pneumatically delivered through the telescoping delivery tube assembly which is provided with a plurality of guides which slidably support and guide each tube of smaller diameter into the adjacent tube of larger diameter, the straps enabling air, as a result of a venturi effect to enter into the gap regions. On the other hand, air is permitted to flow outwardly through the gap regions due to any blockage or clogging within the telescoping arrangement, thus aiding in the clearing of any blockage.

The free end of the telescoping assembly is coupled to the mixing tube through an elbow and a bell reducer. To prevent undue wearing of the elbow, a hollow rugged collector box is welded to the outer convex bend of the elbow so that as aggregate engages and erodes the outer convex bend of the elbow the aggregate is collected in the collector box and acts as a buffer against further wearing by aggregate colliding with the aggregate accumulated within the collector box.

The control of aggregate flow from the gravel hopper into the gravel delivery conduit is regulated by a rotatably mounted plate having a plurality of openings at spaced intervals therealong which may, for example, range from two through five inch diameters. A plurality of coupling brackets, each associated with one of said openings are provided at spaced intervals about the underside of the rotatably mounted plate.

A bifurcated free end of a piston reciprocated by a pivotally mounted hydraulic cylinder is coupled to a selected one of the coupling brackets by means of a pin to align one of the aforesaid openings with an opening at the bottom of the gravel hopper, enabling gravel flow to be controlled without altering the stroke length of the piston operated by the hydraulic cylinder.

A swingably mounted control panel is mounted upon the floor of the truck cabin to the right of the steering wheel, and is supported by a flexible duct assembly comprised of a plurality of flexible ducts each being arranged inside a flexible duct of larger diameter and so that the flexible ducts, which are preferably three in number, each have an outer diameter engaging the inner diameter of the next larger duct section. Control cables and hoses extend through the hollow interior of the flexible ducting. Flexible ducting is coupled at the top and bottom ends to upper and lower nipples, which respectively couple the flexible ducting to a the truck cabin floor and the underside of the control panel. The ends of the flexible ducting assembly are preferably wrapped with tape and then clamped to the nipples, for example by suitable U-clamps. The flexible ducting enables the control panel to be moved to any desired orientation and is capable of retaining such orientation.

OBJECTS OF THE INVENTION

It is therefore one object of the present invention to provide a novel heated mixing tube for mixing molten asphalt and maintaining the asphalt at a suitable elevated temperature.

Another object of the present invention is to provide an asphalt storage tank having alternative electrical and liquid heating systems. The liquid heating system utilizing the cooling system of a vehicle engine provided in a vehicle which transports the storage tank.

Still another object of the present invention is to provide a flexible mounting assembly for a patching vehicle control panel, which is capable of assuming a variety of orientations and maintaining said orientation without the need for additional clamping means.

Still another object of the present invention if to provide a telescoping conduit for delivering aggregate to a mixing head employed in a roadway patching system, wherein said telescoping elements include supporting and guiding means for maintaining gap spaces between the cooperating telescoping elements to provide a self-cleaning effect to prevent blockage by debris collected therein and further to prevent the telescoping elements from experiencing undue expansion forces and/or bursting due to such blockage.

Still another object of the present invention is to provide a novel pivotally mounted flow control gate, capable of assuming a variety of positions to control flow rate while using a hydraulic cylinder having a constant throw.

The above as well as other objects of the present invention will become apparent when reading the accompanying description and drawings in which:

DETAILED DESCRIPTION OF THE INVENTION AND PREFERRED EMBODIMENTS THEREOF

Figure 1A:
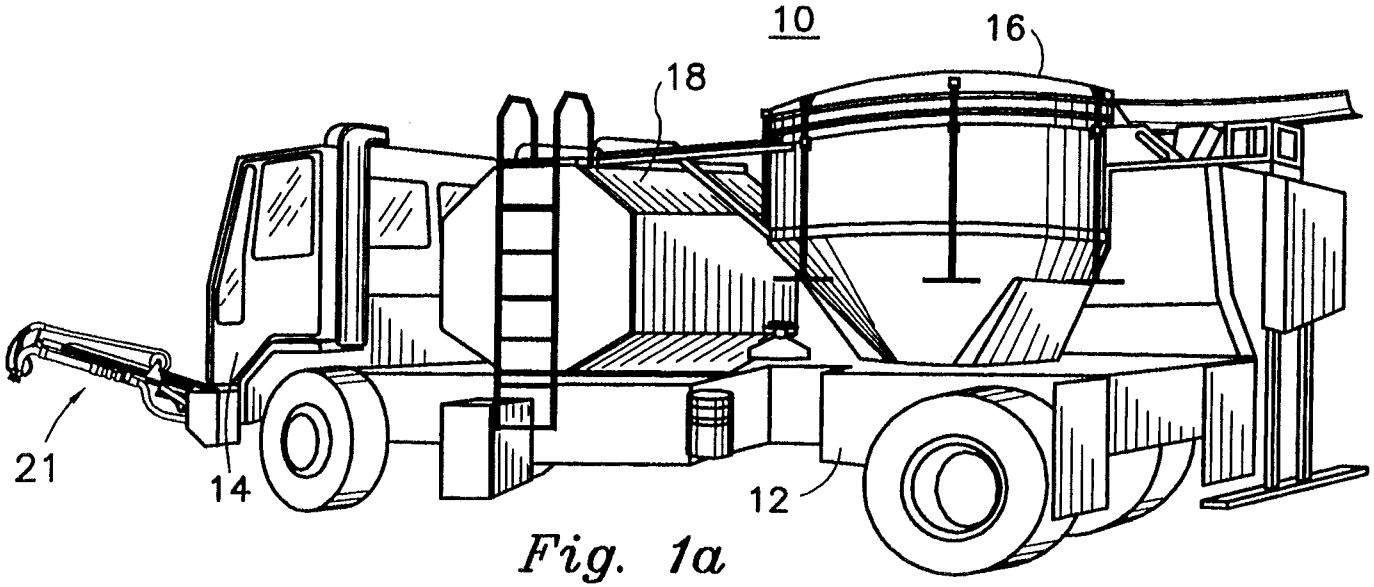
FIGS. 1 and 1*a* are perspective views respectively showing a roadway patching vehicle from the front and from the rear and embodying the principles and features of the present invention.
Figure 1:
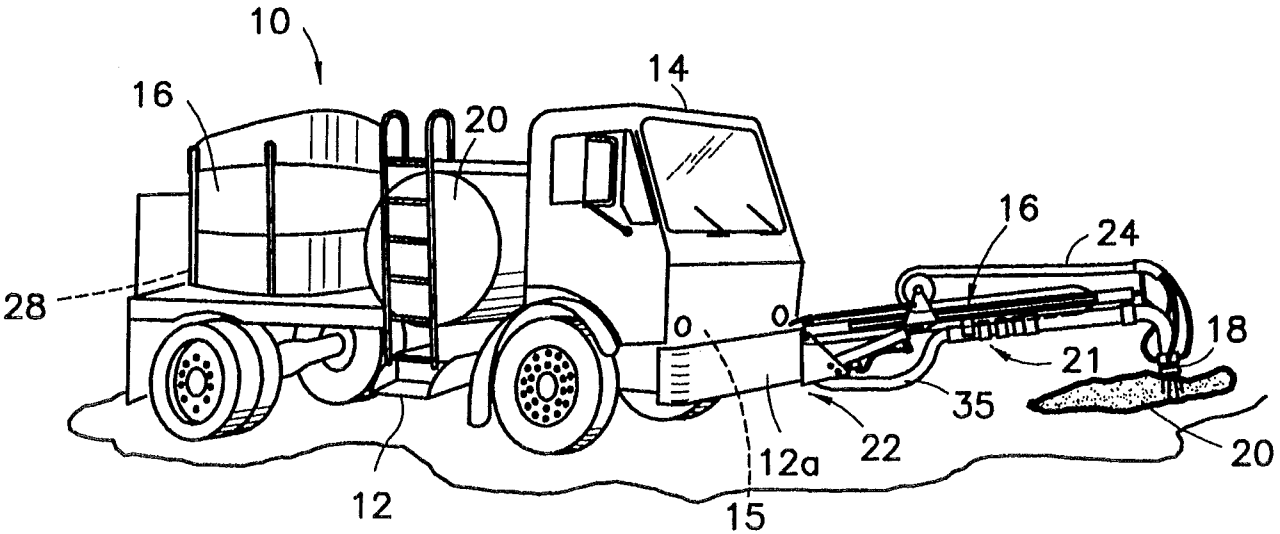
Figure 3C:
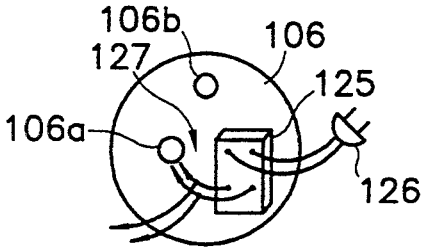
FIG. 3*c* shows a perspective view of the thermostat for controlling auxiliary heating of the tank of FIGS. 3*a* and 3*b*.
Figure 3B:
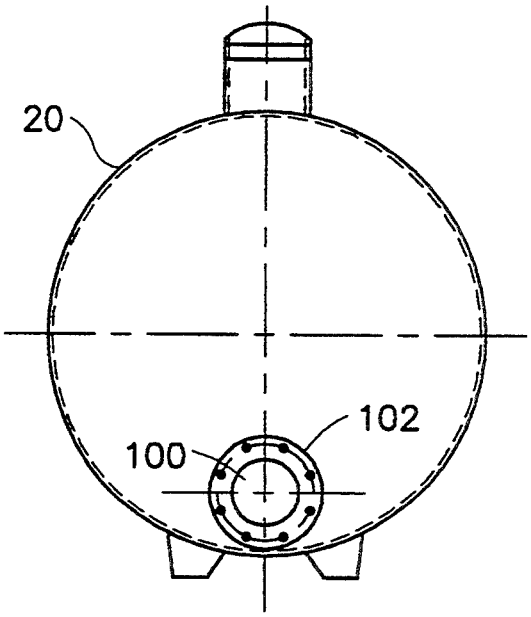
FIGS. 3*a* and 3*b* show side and end elevations of the emulsion tank of FIG. 1.
Figure 3A:
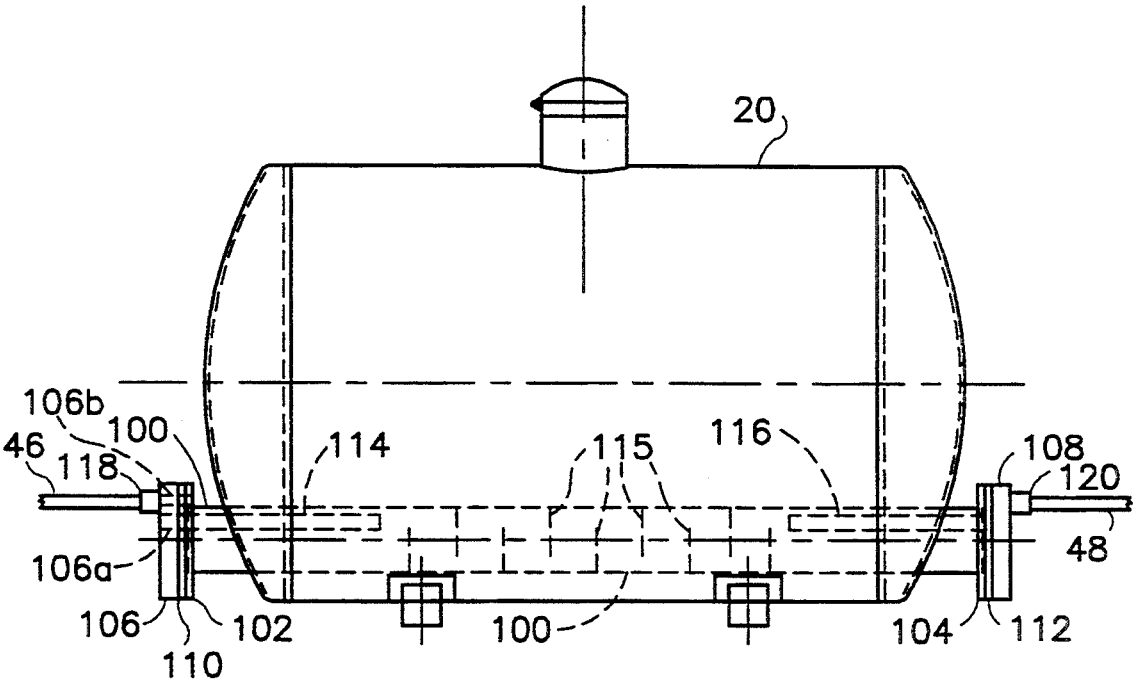

FIG. 1 shows a vehicle 10 for patching roadways and the like through the employment of an asphalt-gravel mixture. A wheeled chassis 12 supports a cab 14 containing the vehicle engine (not shown) which, for purposes of the present invention, may be any type of engine employing a liquid engine cooling system. Chassis 12 supports a gravel hopper 16 and an enclosure 18 of substantially hexagonal shape for enclosing an asphalt tank 20 shown in FIGS. 3*a* and 3*b*.

A front boom assembly 21 is pivotally mounted to the front end of vehicle 10, such as for example, the forward end 12*a* of the chassis 12. The boom assembly is extendable and retractable, and includes a swivel assembly 22, which enables the boom assembly to swing in a horizontal plane as shown by double-headed arrow A, under control of pneumatic cylinder 24, whose piston 24*a* is pivotally coupled to the boom assembly 21 by tracket 21*a*.

The boom assembly 21 is further swingable in a vertical plane under control of cylinder 26, coupled to swivel assembly 22 by a pair of brackets 28. The cylinder piston rod 26*a* is coupled to an elongated hydraulic cylinder 38 by brackets 30. A flexible hose 35 communicates between gravel tank 20 and a mixing head 34 through a telescoping delivery assembly 36.

The telescoping assembly 36 is extended and retracted by means of the cylinder 38 whose piston 38*a* is coupled to bracket 38*b*. The lower end of bracket 38*b* is joined to an elbow 40 coupled to the downstream end of the telescoping delivery tube assembly 36, while the upper end is coupled to an elbow 42 supporting the downstream end of an insulated non-collapsible hose 44 whose hollow interior contains two water lines 46, 48, and an asphalt emulsion line 50. The water lines and emulsion lines extend through the hollow interior of hollow hose 44. The downstream end of hose 44 receives a coupling 52, which is threadedly coupled to a threaded end 42*a* of elbow 42.

Figure 2A:
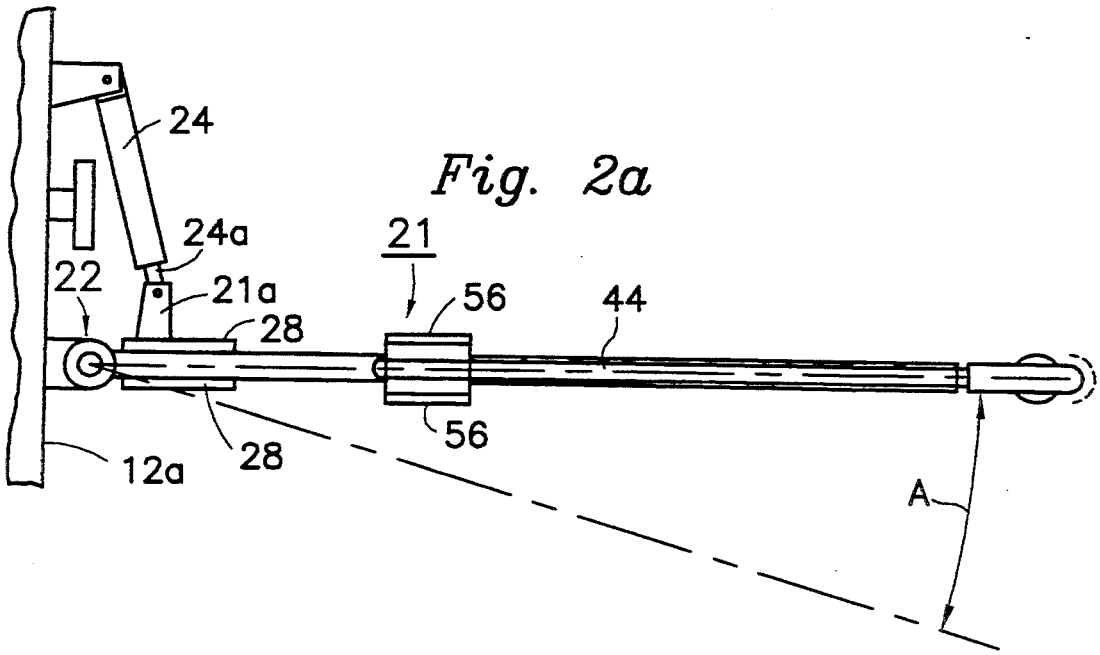
FIGS. 2*a* and 2*b* show top plan and elevational views of the boom assembly of FIG. 1 in greater detail.

Hose 44 extends around a pulley 54 pivotally mounted between a pair of triangular shaped brackets 56, 56 (note also FIG. 2*a*). Each of the brackets is provided with a pair of rollers 58, 60, which ride within a channel track 62. Suitable blocks 62*a*, 62*b* are provided at ends of each channel track to limit the movement of the rollers 58, 60. The hose 44 terminates in an elbow 64, end 44*a* of hose 44 being threadedly engaged to one end of the elbow 64. A second hose section 66 (see FIG. 3*a*) is coupled between the upstream end of elbow 64 and a fitting 20*a* provided at the bottom of asphalt storage tank 20.

An inner 68 and an outer spring 70 have their left hand ends secured to a post 72 mounted upon cylinder 38 and have their right hand ends coupled to an eyelet 74*a* at the left hand end of a substantially U-shaped bracket 74 pivotally coupled to the triangular shaped brackets 56, 56.

The S-shaped configuration of hose 44 maintains the hose under tension and prevents the hose from sagging regardless of whether the boom is expanded or contracted.

More particularly, when cylinder 38 moves its piston 38 to the right, bracket 38*b* pulls hose 44 to the right against the force of springs 68, 70 and simultaneously moves elbow 40 to the right causing the pulley 54 to move to the right against the force of the tension springs 68, 70. Elbow 64 relieves any stress from the hose portion 44 under tension, elbow 64 being secured by a fillet weld to the housing of cylinder 38.

Retraction of the piston rod 38*a* into cylinder 38 moves the downstream end 44*b* of hose 44 to the left. However, any slack in the hose is immediately taken up by inner and outer springs 68, 70, which urge pulley 54 to the left to constantly maintain tension in hose portion 44. The hose portion 66 extending between elbow 64 and tank 20 does not experience any slackening due to the expansion and/or contraction of the boom cylinder 28.

The telescoping gravel delivery assembly 36 expands and contracts with the extension and retraction of piston rod 28*a*.

The expanding/contraction capabilities prevents both the gravel and the asphalt delivery conduits from becoming tangled or worn due to contact with the ground, which would otherwise be the case without the novel arrangement of the present invention.

Figure 5:
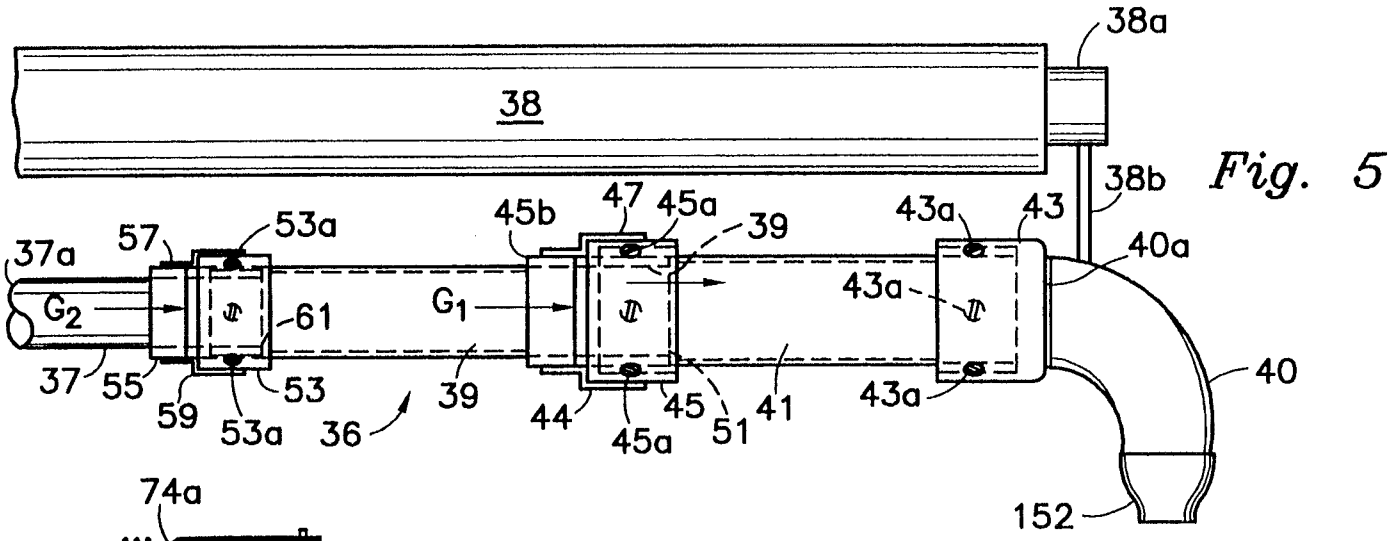
FIG. 5 shows a side view of the telescoping gravel delivery tube of the present invention.
Figure 2C:
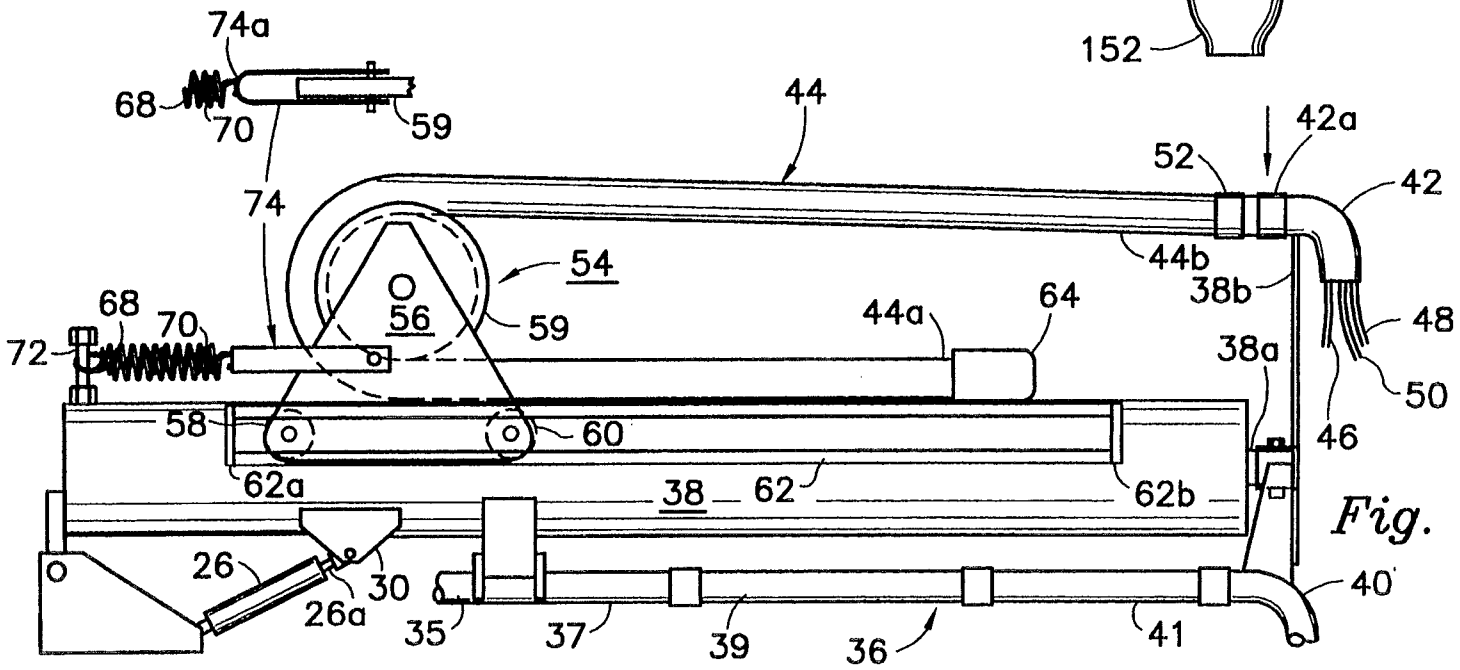
FIG. 2*c* is an elevational view showing further details of the boom assembly of FIGS. 1, 2*a* and 2*b*.

The telescoping assembly 36 shown best in FIG. 5 is comprised of tubular sections 37, 39 and 41, which in one preferred embodiment comprise hollow plastic tubes, preferably made of PVC. The right-hand end of tube 41 is provided with a coupling 43 bolted thereto at 43*a*, and welded at 40*a* to the upstream end of elbow 40, which is preferably a 4 inch steel elbow. The left-hand end of tube 41 has secured thereto a steel tube 45 surrounding tube 41 and having a $4\frac{1}{2}$ inch inner diameter, which is the same as the $4\frac{1}{2}$ outer diameter of tube 41. Steel tube 45 is secured to tube 41 by suitable bolts 45*a*, as shown. The right-hand end of tube 39 is slidably received within a steel tube 45*b*, which is supported by a pair of steel straps 47, 49, which are welded to the outer periphery of tube 45 and the outer periphery of tube 45*b*, straps 47, 49 being diametrically opposed from one another. Tube 45 is positioned relative to tube 45*b* so as to provide a gap space $G_1$ of the order of 0.25 to 0.5 inches and preferably 0.375 inches. This gap serves as a debris exit, as will be more fully described.

A two inch long tube 51, preferably formed of PVC, is fixedly secured by a suitable glue or epoxy (or threaded members, if desired) to the outer periphery of tube 39, and at the right-hand end thereof. Tube 51 serves as a stop preventing tube 39 from being further withdrawn from the interior of tube 41 when the left-hand end of stop member 51 engages the right-hand edge of tube 45.

A similar arrangement is provided relative to tubes 37 and 39 in that a steel tube 53 is secured to the outer periphery of tube 39 at the left-hand end thereof by three suitable fasteners 53*a* as shown, and tube 53 supports a tube 55 of smaller diameter by means of straps 57 and 59 to provide a gap space $G_2$ between tubes 53 and 55.

Tube 55 slidingly supports tube 37, which has secured to the outer periphery thereof a tube 61 formed of PVC, and being secured by a suitable glue or epoxy, for example. Tube 61 acts as a stop in the same manner as tube 51 in that its left-hand end engages the right-hand end of guide tube 55 limiting the extent to which tube 37 may be removed from tube 39.

In the arrangement shown, the smaller diameter tube 37 is positioned upstream from the next smaller diameter tube 39 so that as the gravel is pneumatically forced therethrough, there is no wearing of the ends of the tubes by gravel passing therethrough if the diameters of the tubes were reversed.

The gravel enters into the telescoping tube assembly 36 at the left-hand end and passes through the right-hand end and elbow 40 into a mixing head 34 to be described in greater detail hereinbelow.

The gravel flow at a suitable feed rate is assured by a suitable pneumatic device such as a pump, which pneumatically forces gravel delivered to the gravel conveying tube 35 from the gravel hopper 16 (to be more fully described). This air flow creates a venturi effect causing some air to enter from the exterior of the telescoping delivery tube assembly. The pressurized air nevertheless assumes the path of least resistance and moves along the interior of tube assembly 36, elbow 40 and mixing head 34.

In the event of any blockage or clogging of the assembly, air is free to escape through the debris exits to prevent over-pressurization of the assembly. In addition, debris may be blown out of the telescoping delivery tube assembly through the debris exits providing a unique telescoping arrangement.

Figure 4B:
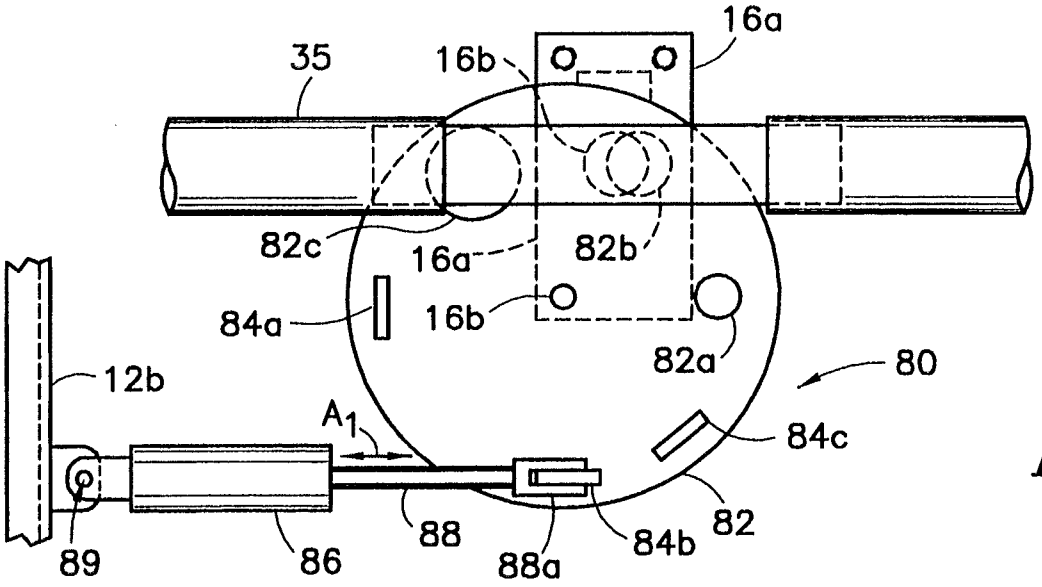
FIG. 4*b* shows a plan view of the control of FIG. 4*a* with the gravel tank removed.
Figure 4A:
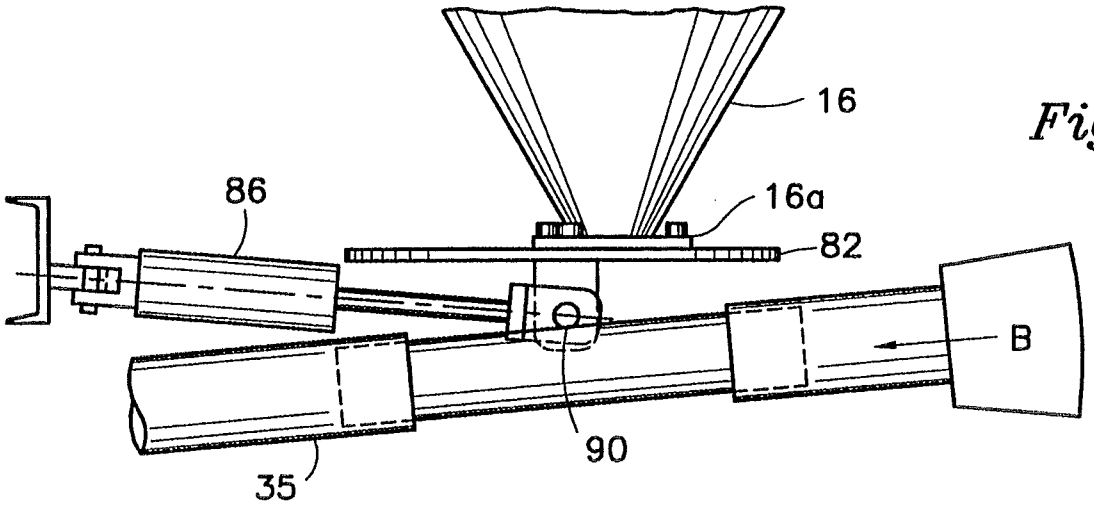
FIG. 4*a* shows an elevational view of the gravel feed control of the present invention.
Figure 5A:
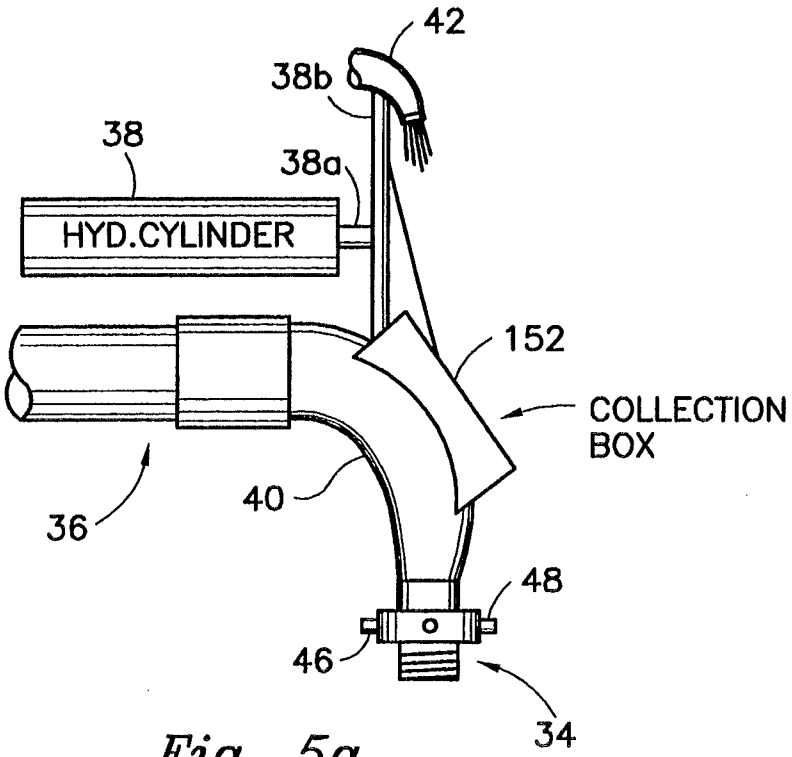
FIG. 5*a* shows a detailed view of a collector box, which may be utilized with the telescoping delivery tube of FIG. 5.

The left-hand-most telescoping tube member 37 is joined to a conduit 35, which extends between a suitable pneumatic device such as an air blower B shown in FIG. 4*a*, and the upstream end 37*a* of tube 37 by employing any suitable coupling means.

The gravel supply tank 16 preferably has a tapered configuration as shown in FIG. 4*a*, and is provided with a substantially circular-shaped outlet at its bottom end, the outlet opening being provided in a plate 16*a*.

Figure 2B:
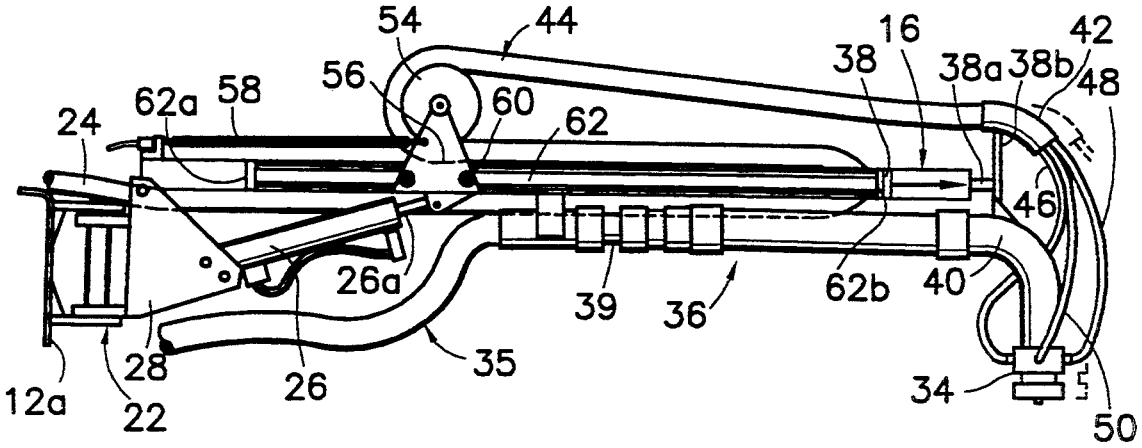

The elbow 40 shown, for example in FIG. 2*b*, is provided to deflect the flow of gravel from a substantially horizontal direction to a substantially downward vertical direction and thereafter into mixing head 34. The constant movement of gravel against the outer end of elbow 40 causes wearing in this region, which results in the necessity to frequently replace elbow 40.

The present invention provides a collector box 152, which is formed of a suitable metallic material, and has an open end which is welded to the periphery of elbow 40. The collector box 152 is hollow. The operation of the collector box is as follows:

Gravel impinges upon the interior surface of elbow 40 as it is deflected from a substantially horizontally movement to a substantially downward vertical movement. The constant impingement of gravel upon the elbow 40 causes wearing away of the elbow. Eventually, portions of the elbow along the outer diameter wear through causing gravel particles to enter into the collection box 152, and to be collected therein. Ultimately, the collection box 152 is filled whereby the gravel within the collection box serves as a barrier wall or buffer replacing the portion of the elbow 40, which has been eroded due to constant impingement of gravel against the elbow. The collection box significantly increases the life of the elbow, thus reducing operating costs due to a reduction in the amount of replacement operations and replacement parts, which are otherwise required in the absence of collector box 152.

An assembly 80 for controlling the feed rate of gravel from tank 16 into conduit 35 is comprised of a swingably mounted plate 82 pivotally connected to plate 16*a* at pivot point 16*b*. Plate 82 is provided with a plurality of openings 82*a*, 82*b* and 82*c*, for example of increasingly greater diameter. A plurality of brackets 84*a*, 84*b* and 84*c* each associated with one of the openings 82*a* through 82*c* are secured to the underside of plate 82, and may be coupled to the bifurcated end 88*a* of piston rod 88 by means of pin 90. A hydraulic cylinder 86, which is pivotally connected to a cross-member 12*b* of the vehicle chassis by pin 89, controls the reciprocating movement of piston rod 88 as shown by double-headed arrow $A_1$.

By moving the plate 82 so that one of the openings 82*a* through 82*c* cooperates with the opening 16*b* in the bottom of tank 16, the flow rate may be controlled. This is accomplished as follows:

Pin 90 is removed from piston rod 88. Piston rod 88 is displaced from the bracket to which it is connected, and plate 82 is rotated so that the bracket associated with the desired flow control opening is moved to the position presently occupied by bracket 84*b* as shown in FIG. 4*b*. When the proper bracket is so positioned, the bifurcated end 88*a* of piston rod 88 is secured to the desired bracket by replacement of pin 90. Operation of cylinder 86 moves plate 82 through a predetermined angle sufficient to move the selected opening between a position in which the selected opening is displaced from the tank opening 16*b* to prevent the flow of material to a position in which the selected opening is substantially aligned with opening 16*b* permitting the flow of gravel from tank 16 into delivery hose 35 according to the size opening of plate 82 positioned relative to the opening at the bottom of tank 16. Preferably, the opening at the bottom of the tank may be chosen so as to be greater than any of the openings 82*a* through 82*c* provided in plate 82. In one preferred embodiment, the plate may be provided with openings ranging in diameter from two to five inches. The extension of piston rod 88 is sufficient to assure closure and opening of the gravel hopper regardless of the control opening being used.

The asphalt tank 20 maintains the contents in a molten state by alternative heating means comprising an elongated tube 100, which extends through suitable openings near the bottom end of tank 20 and is welded to tank 20 to provide a liquid tight seal therebetween and to separate the flow of coolant through tube 100 from the molten asphalt within tank 20. Each free end of tube 100 is provided with a flange 102, 104. A blind flange 106, 108 is bolted to each end flange 102, 104. A resilient gasket 110, 112 is sandwiched between each of the blind flanges 106, 108 and the end flanges 102 and 104.

Since each blind flange is substantially similar, only one of said flanges will be described herein in detail, for purposes of brevity. Blind flange 106 is provided with an opening 106*a* for receiving an electrical heating element 114, which extends a pre-determined depth, typically 18 inches, into the hollow interior of tube 100. A support for element 114 threadedly engages a tapped opening 106*a* in blind flange 106. A similar heating element 116 extends inwardly into the opposite end of tube 100 and is secured to blind flange 108. The heating elements may be similar to conventional electrical heating elements employed in conventional hot water heaters, although any other equivalent electrical heating element may be employed, which is suitable for use in heating a liquid flowing about the element. An opening 106*b* is provided in blind flange 106, and is fitted with a suitable coupling 118 for connecting water line 46 thereto (see FIG. 2*b*). The couplings 118, 120 are watertight. A similar coupling 120 is provided for coupling water line 48 thereto.

Water lines 46 and 48 are coupled to the engine cooling system (not shown for purposes of simplicity) causing the flow of coolant through tube 110 whenever the vehicle engine is operating. In the preferred embodiment, tube 100 is initially filled with a suitable anti-freeze so that, when tube 100 is coupled to the engine cooling system, the anti-freeze within tube 100 assures that the level of anti-freeze protection for the cooling system is at least as good if not superior to the anti-freeze protection level when the tube 100 is not connected to the cooling system.

In the event that asphalt is stored within tank 20 during periods in which the truck is not in use, and in order to avoid the necessity for emptying and cleaning the tank during periods of non-use, such as overnight storage, the auxiliary heating elements 114, 116 are electrically connected to a suitable local power source such as 110 volts AC (not shown) by coupling of a thermostatic control 125 to such power source through a suitable plug connector 126.

Thermostatic control 125 is mounted flush with the surface of blind flange 106, for example, and is provided with electrical connections 127 for heater elements 114 and 116.

Assuming that the road patching vehicle 10 is being stored overnight and has a significant amount of molten asphalt within tank 20, in order to protect against solidification of the asphalt due to cooling, the vehicle is parked in an area where there is reasonable access to a local AC power source. Plug 126 is connected with the power source and, even though the vehicle engine is turned off, thermostatic control 125 monitors the temperature of the molten asphalt by measuring the temperature at blind flange 106 in order to simultaneously, electrically energize heating elements 114, 116 whenever appropriate, to maintain the desired temperature level of the molten asphalt within tank 20.

Figure 6B:
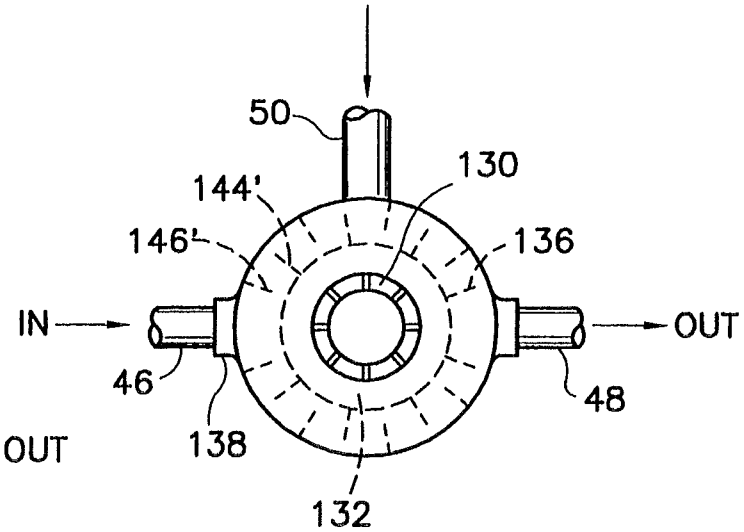
FIG. 6*b* shows a top plan view, partially sectionalized, of the mixing head of FIG. 6*a*.

The thermostatic control 125 is disconnected from electrical power preparatory to transport of the road patching vehicle to a job site, whereupon the engine cooling system assumes the responsibility for maintaining the molten asphalt at the proper temperature. In addition thereto, when the road patching vehicle 10 is employed in near freezing or sub-freezing temperatures zones, for example, the coolant residing in tube 100 at the time that the vehicle engine is started is at substantially the same temperature level as the molten asphalt. This coolant flows through the cooling system and substantially instantaneously heats the vehicle engine greatly facilitating and expediting the start-up of the vehicle engine. During the initial start-up period, as coolant circulates through tube 100, the heat stored in the molten asphalt within tank 20 is conveyed to the coolant through the wall of conductive metallic tube 100, further enhancing the heating of the cooling system and engine block, which is extremely valuable during engine start-up. The interior of tube 100 is provided within baffle plates 115, which assure flow of coolant against the entire interior surface of tube 100 to assure good heat transfer from the coolant to the molten asphalt. The baffle plates 115 may be staggered, as shown, or arranged in any other suitable fashion, similar to the baffle plates 144, 146 employed in mixing head 34 (see FIG. 6*b*).

Figure 6A:
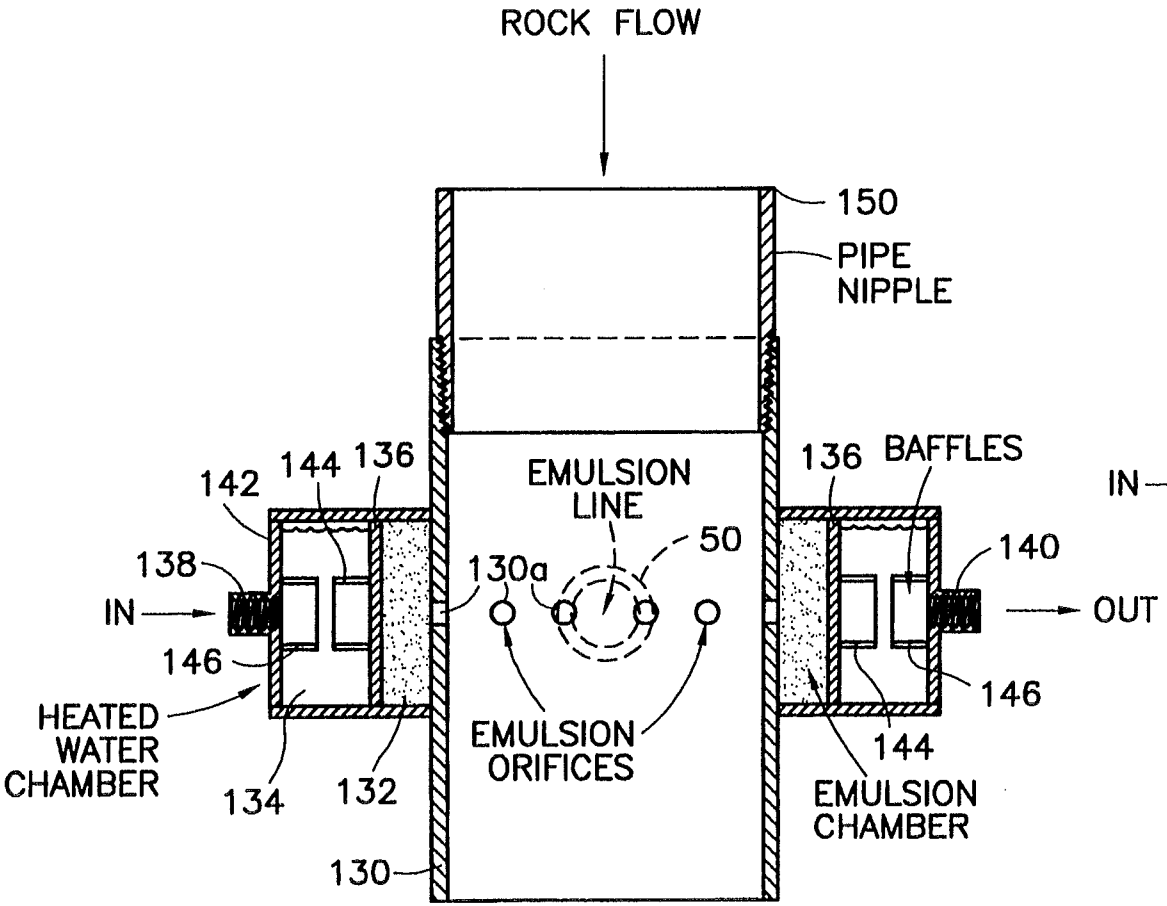
FIG. 6*a* shows a sectional view of the heated mixing head of the present invention.

The vehicle engine cooling system is also utilized to heat mixing head 34 during the application of a mixture of molten asphalt and gravel when performing a road patching operation. As was pointed out hereinabove, the gravel conduit and molten asphalt line are coupled to the mixing head to be admixed preparatory to application upon a roadway. FIG. 6*a* shows a sectional view of the mixing head comprising a hollow, cylindrical member 130 having openings 130*a* at spaced intervals about the periphery thereof, for purposes of communicating with an emulsion chamber, which comprises a substantially annular-shaped hollow chamber coupled to emulsion line 50. The emulsion line 50 extends through a portion of the outer heating chamber 134, which is a substantially annular-shaped chamber surrounding chamber 132, and sharing a common barrier wall 136. Wall 136 is formed of a metallic material, which is a good conductor of heat. The water lines 46 and 48 are coupled to the heating chamber 134 by suitable coupling means 138, 140. The coolant, such as water or a mixture of water and anti-freeze, passes from line 46 into heating chamber 134, and flows out of heating chamber 134 through line 48. The heating chamber is preferably provided with a plurality of baffles, which are arranged to extend radially outwardly from barrier wall 136, and radially inwardly from outer wall 142. If desired, the baffles may extend downwardly from the upper interior and upwardly from the lower interior. The baffles 144, 146 may be arranged in the manner shown in FIG. 6*a* or alternatively may be staggered and overlapping as shown by the baffles 144', 146' of FIG. 6*b*. The baffles serve to assure equalization of flow in the clockwise and counterclockwise direction from water line 46 so as to assure even heating about the heating chamber. Heat from the heating chamber is conducted to the emulsion chamber 132 through metallic conductive barrier 136. The molten asphalt flows from asphalt line 50 into the emulsion chamber and enters into the interior of hollow, cylindrical member 130, being directed substantially radially inwardly through each of the openings 130*a*. Rock or gravel flow enters into the upper end of hollow cylindrical tube 130 by means of pipe nipple 150 which is preferably coupled to bell reducer 152 at the downstream end of the telescoping delivery tube assembly 36, shown in FIG. 5. The liquid coolant from the engine cooling system assures that the molten asphalt is at the appropriate temperature as it passes from the emulsion chamber 132 into the cylindrical mixing tube 130.

The molten asphalt may be gravity fed or alternatively may be pressurized to assure proper advancement of the asphalt to mixing head 34.

The control unit 155 for the patching system is comprised of a control panel housing 156 having an operating joystick 157 for controlling the orientation of the boom assembly 21 having a plurality of control switches 158 and instruments such as a timer 159.

Figure 7A:
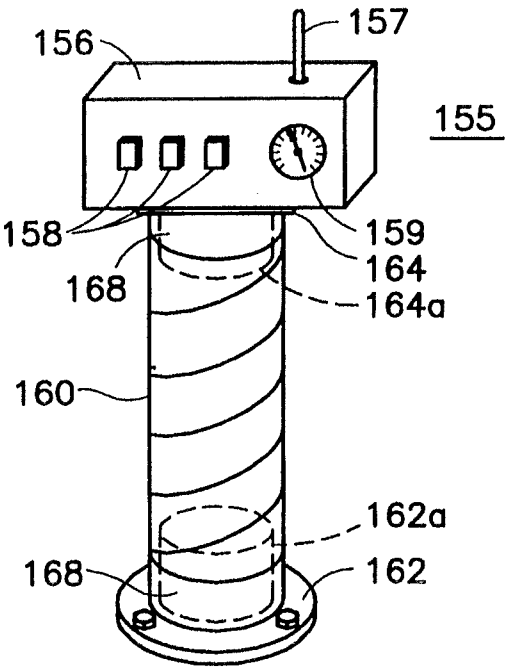
FIG. 7*a* is a perspective view of a control and a flexible mounting assembly therefor.
Figure 7B:
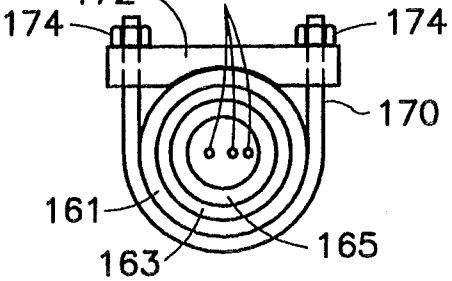
FIG. 7*b* shows one clamping assembly for the flexible mounting assembly of FIG. 7*a*.

The control is mounted upon a flexible assembly 160 in order to permit the control assembly 155 to be oriented in any suitable angle to facilitate both observation and utilization of the control members. The flexible assembly 160 in FIG. 7*b* comprises three flexible, hollow, metallic ducts 161, 163 and 165 formed of a spiralling member. Each duct of smaller diameter is forced fitted into the next duct of larger diameter, the outer diameter of each inner duct being in intimate engagement with the inner diameter of the outer duct which it engages. The flexible ducts, when telescoped into one another in this force- fitting manner, provide a flexible mount 160, which serves to support the control panel at any desired orientation to which the control panel is moved. The hollow interior of the flexible duct assembly 160 provides a hollow protective passageway for electrical, pneumatic or other conduits 167 for coupling the switches, controls and instrumentation of the control assembly 155 to the appropriate operating devices, electrical power and the like.

The flexible duct assembly 160 is mounted upon the truck cabin floor by means of a nipple 162. The underside of control panel 156 has secured thereto a similar nipple 164. The lower end of flexible duct 160 is fitted over the nipple 162 while the upper end is fitted over the nipple 164. The upper and lower ends of the flexible duct assembly 160 are preferably taped at 166 and 168. Clamps such as, for example, muffler-type clamps comprising a U-shaped member 170 and a cross piece 172, and bolts 174 firmly secure the upper and lower end of the flexible ducting assembly to each of the nipples 164 and 162. The nipple flanges 162*a*, 164*a* are respectively secured to the cabin floor and the underside of control panel 156 by suitable threaded fasteners.

A latitude of modification, change and substitution is intended in the foregoing disclosure, and in some instances, some features of the invention will be employed without a corresponding use of other features. Accordingly, it is appropriate that the appended claims be construed broadly and in a manner consistent with the spirit and scope of the invention herein described.

What is claimed is:

1. Telescoping conveying means for conveying solid matter comprising:

at least first and second hollow tubular members of different diameters;

said first tubular member having a first end being telescopingly received by and extending into a first end of said second tubular member which is of a larger diameter than said first tubular member;

a collar positioned about an outer periphery of and coupled near the first end of said second tubular member;

guide means mounted to said collar for slidably receiving and guiding said first tubular member;

said guide means arranged a spaced distance from said collar and maintaining a substantially uniform gap space between an outer periphery of said first tubular member and an inner periphery of said second tubular member;

a second end of said first tubular member receiving solid matter urged through said telescoping conveyor means by air under pressure, causing ambient air to enter said gap space through a region between said collar and guide means to keep the gap space free of debris.

2. The telescoping conveyor means of claim 1 further comprising stop means secured near the first end of said first tubular member, said guide means being positioned in a path of movement of said stop means to prevent said first tubular member from being completely removed from said second tubular member.

3. The telescoping means of claim 1 wherein said tubular members are formed of PVC.

4. The telescoping means of claim 1 wherein said guide means is a metallic tube;

strap means coupling said metallic tube to said mounting means and maintaining said metallic tube a spaced distance from said first end of said second tubular member.

5. The telescoping conveying means of claim 1 further comprising outlet means coupled to a second end of said second tubular member for dispensing said solid material.

6. The telescoping conveying means of claim 5 wherein said outlet means comprises a hollow elbow having a first end coupled to the second end of said second tubular member.

7. The telescoping conveying means of claim 6 further comprising collector box means mounted on an outside curved convex portion of said elbow for collecting solid matter which may pass through an opening in the outside curved portion of said elbow which opening is formed due to solid matter eroding said elbow to form said opening.

8. The telescoping conveying means of claim 7 wherein said collecting means is of a size sufficient to collect solid matter therein and passing through said opening which collected solid matter acts as a buffer to prevent erosion of said collector box means.

9. The telescoping conveying means of claim 8 wherein said elbow and said collector box means are metallic and said collector box means is a hollow member having an open end, a rim surrounding and defining said open end being secured to said elbow.

10. The telescoping conveying means of claim 9 wherein said rim is secured to said elbow by welding.

11. The telescoping conveying means of claim 1 wherein said solid material is crushed stone or its equivalent.

12. The telescoping conveying means of claim 11 wherein said air under pressure is provided by means for introducing air into the second end of said first tubular member.

13. The telescoping conveying means of claim 1 wherein said first and second tubular members are formed of a plastic material.

14. The telescoping conveying means of claim 13 wherein said first tubular member has an outer diameter of 3.50 inches, said second tubular member has an inner diameter of greater than 4.0 inches, and said guide collar has an inner diameter less than the inner diameter of said second tubular member and substantially equal to the outer diameter of said first tubular member.

15. The telescoping conveying member of claim 14 wherein the blocking collar has an outer diameter greater than the inner diameter of said guide collar.

16. The telescoping conveying member of claim 1 wherein the gap between said guide means and said collar is 0.375 inches for enabling debris to exit.

17. A mixing head assembly for mixing solid material and liquid material comprising;

a hollow annular member having an inlet end for receiving said solid material and an outlet end for delivering solid material mixed with said liquid material;

a first hollow, annular-shaped enclosure surrounding and contiguous with an intermediate portion of said cylinder member and having an inlet opening for introducing said liquid material into a hollow interior of said first enclosure;

a plurality of openings provided in said annular member for introducing liquid material entering said first enclosure into an interior of said cylinder member where it is mixed with said solid material;

a second hollow, annular-shaped enclosure surrounding and contiguous with said first enclosure, and having first and second openings for respectively introducing a heated liquid into an interior of said second enclosures and for removing said heated liquid therefrom for heating the liquid material introduced into said first enclosure; and baffle means in said second enclosure disturbing the smooth, flow of liquid through said second enclosure.

18. The mixing head assembly of claim 17 wherein said baffle means comprises a plurality of baffle plates arranged at spaced intervals about an interior of said second enclosure and oriented generally in a radial direction.

19. The mixing head assembly of claim 18 wherein said baffle plates extend inwardly from an outer interior wall of said second enclosure.

20. The mixing head assembly of claim 18 wherein said baffle plates extend outwardly from an inner interior wall of said second enclosure.

21. The mixing head assembly of claim 18 wherein a first group of said baffle plates extend outwardly from an inner annular portion of said second enclosure and a second group of baffle plates extend inwardly from an outer annular portion of said second enclosure.

22. The mixing head assembly of claim 21 wherein said first and second groups of baffle plates overlap one another to define a tortuous flow path.

23. The mixing head assembly of claim 21 wherein said first and second groups of baffle plates are arranged in alternating fashion.

24. The mixing head assembly of claim 18 wherein a first group of said baffle plates extend from one interior surface of said enclosure and a second group of said baffle plates extend from another interior surface of said second enclosure.

25. The head assembly of claim 24 wherein said first and second groups of baffle plates overlap one another to define a tortuous flow path.

26. The mixing head assembly of claim 17 further comprising a conduit coupled to said first enclosure inlet;

one-way valve means in said conduit to permit liquid flow in a first direction toward said inlet and to prevent reverse flow in a second direction from said inlet into said conduit.

27. The mixing head assembly of claim 17 wherein the inlet openings in said annular member are arranged at spaced intervals about said annular member.

28. The mixing head assembly of claim 17 wherein said solid material comprises crushed stone.

29. The mixing head assembly of claim 28 wherein said liquid material comprises a material for repairing road surfaces.

30. The mixing head assembly of claim 17 wherein said liquid material comprises a material for repairing road surfaces.

31. The mixing head assembly of claim 30 wherein said liquid material comprises a material for repairing road surfaces taken from the group including resin, tar and macadam.

32. A mixing head assembly for mixing solid material and liquid material comprising:

a conveying conduit having an inlet for receiving said solid material, an intermediate portion having openings for receiving said liquid material and an outlet for delivering solid material mixed with said liquid material;

chamber means surrounding said intermediate portion for delivering liquid material to said openings;

heating means surrounding said chamber means for heating the contents of said chamber means; and said heating means receiving a heated liquid and having baffle means for disturbing the smooth flow of heated liquid therethrough.

33. A mixing head assembly for mixing solid material and liquid material comprising:

a conveying conduit having an inlet for receiving said solid material, an intermediate portion having openings for receiving said liquid material and an outlet for delivering solid material mixed with said liquid material;

chamber means surrounding said intermediate portion for delivering liquid material to said openings;

heating means for heating the contents of said chamber means;

said heating means receiving a heated liquid and having baffle means for disturbing the smooth flow of heated liquid therethrough; and said heated liquid being delivered from an engine cooling system having a outlet coupled to an inlet in said chamber means and a return coupled to an outlet in said chamber means.

34. Apparatus for controlling delivery of solid matter comprising:

a tank for solid matter having an outlet opening;

a delivery conduit having an air inlet, an outlet for delivering solid matter and a solid matter inlet intermediate said inlet and outlet;

a gate assembly arranged between said tank outlet and hose inlet and having a plate rotatable about a pivot and having a plurality of openings of different sizes;

reciprocating means for moving said plate;

a plurality of brackets mounted on said plate for selective coupling with said reciprocating means, each bracket being associated with one of said openings whereby an opening associated with the bracket coupled to said reciprocating means selectively controls the flow of solid matter in a passageway arranged between said tank outlet and said delivery conduit solid matter inlet;

said reciprocating means being movable between a first and a second position whereby the opening associated with the bracket coupled to said reciprocating means is respectively movable between first and second positions respectively opening and closing said passageway.

35. The apparatus of claim 34 wherein said reciprocating means comprises a cylinder having a reciprocating position coupled to a piston rod; and coupling means for releaseably coupling said rod to one of said brackets.

36. Apparatus for heating the contents of a tank mounted upon a vehicle driven by an engine having an engine cooling system employing a liquid coolant circulating through said engine, said apparatus comprising:

heating means including a hollow conductive tube for coupling with the engine cooling system extending through an interior portion of said tank for separating the flow of a coolant through said tube from the contents of said tank to be heated;

means for coupling said tube to said cooling system to enable flow of a coolant circulating through said engine cooling system through said tube and returning to said engine, when said engine is operating; and said tube conducting heat from said coolant to heat the contents of said tank.

37. The heating means of claim 36 further comprising baffle means provided in said tube to enhance the transfer of heat from said coolant to said tank contents through said tube.

38. The heating means of claim 37 wherein said tube is formed of a metal having good heat conductivity.

39. Apparatus for heating the contents of a tank mounted upon a vehicle driven by an engine having an engine cooling system employing a liquid coolant circulating through said engine, said apparatus comprising:

heating means including a hollow conductive tube for coupling with the engine cooling system extending through said tank for separating the flow of a coolant through said tube from the contents of said tank to be heated;

means for coupling said tube to said cooling system to enable flow of a coolant in said engine cooling system through said tube, when said engine is operating; and said tube conducting heat from said coolant to heat the contents of said tank;

electrical heating means extending into said tube;

means for electrically coupling said electrical heating means to a source of electrical energy to selectively heat said electrical heating means when said vehicle engine is not operating.

40. The heating means of claim 39 further comprising:

thermostatic control means for selectively energizing said electrical heating means when temperature sensing means included in said control means detects that the temperature of said tube drops below a first predetermined level and for selectively deenergizing said electrical heating means when the temperature of said tube rises above a second predetermined temperature.

41. The heating means of claim 40, including metallic end cap means for sealing the ends of said tube;

said thermostatic control means being mounted on one of said end cap means for sensing the temperature in said tube.

42. Apparatus for heating the contents of a tank mounted upon a vehicle driven by an engine having an engine cooling system employing a liquid coolant circulating through said engine, said apparatus comprising:

heating means including a hollow conductive tube for coupling with the engine cooling system extending through said tank for separating the flow of a coolant through said tube from the contents of said tank to be heated;

means for coupling said tube to said cooling system to enable flow of a coolant in said engine cooling system through said tube, when said engine is operating; and said tube conducting heat from said coolant to heat the contents of said tank;

a mixing head assembly for mixing solid material and the contents of said tank which comprises a liquid material comprising:

a hollow annular member having an inlet end for receiving said solid material and an outlet end for delivering solid material mixed with said liquid material;

a first hollow, annular-shaped enclosure surrounding and contiguous with an intermediate portion of said cylinder member and having an inlet opening for introducing said liquid material into a hollow interior of said first enclosure;

a plurality of openings provided in said annular member for introducing liquid material entering said first enclosure into an interior of said cylinder member where it is mixed with said solid material;

a second hollow, annular-shaped enclosure surrounding and contiguous with said first enclosure, and having first and second openings for respectively introducing a said coolant into an interior of said second enclosure and for removing said coolant therefrom for heating the liquid material introduced into said first enclosure.

* * * * *